US010736421B2

(12) United States Patent
Liao et al.

(10) Patent No.: US 10,736,421 B2
(45) Date of Patent: Aug. 11, 2020

(54) EXTERNAL MOUNTED SLOW-RETURN SLIDE RAIL ASSEMBLY

(71) Applicant: Nan Juen International Co., Ltd., Taoyuan (TW)

(72) Inventors: Wei-Liang Liao, Taoyuan (TW); Kun-hsiang Chen, Taoyuan (TW); Guo-Zhi Huang, Taoyuan (TW); I-Hsiang Chiu, Taoyuan (TW)

(73) Assignee: Nan Juen International Co., Ltd., Taoyuan (TW)

( * ) Notice: Subject to any disclaimer, the term of this patent is extended or adjusted under 35 U.S.C. 154(b) by 0 days.

(21) Appl. No.: 16/536,637

(22) Filed: Aug. 9, 2019

(65) Prior Publication Data

US 2020/0093264 A1 Mar. 26, 2020

(30) Foreign Application Priority Data

Sep. 26, 2018 (TW) ..... 107133814 A

(51) Int. Cl.

| | |
|---|---|
| ***A47B 88/46*** | (2017.01) |
| ***A47B 88/47*** | (2017.01) |
| ***A47B 88/467*** | (2017.01) |
| ***A47B 88/477*** | (2017.01) |

(52) U.S. Cl.

CPC ..... *A47B 88/467* (2017.01); *A47B 88/477* (2017.01); *A47B 2210/0018* (2013.01); *A47B 2210/0091* (2013.01)

(58) Field of Classification Search

CPC ..... A47B 88/453; A47B 88/46; A47B 88/467; A47B 88/40; A47B 88/473; A47B 88/477; A47B 88/047; A47B 2088/4675; A47B 2088/0474; A47B 2210/0018; A47B 2210/0091; A47B 2210/0094

See application file for complete search history.

(56) References Cited

U.S. PATENT DOCUMENTS

| | | | | |
|---|---|---|---|---|
| 5,207,781 A * | 5/1993 | Rock | E05B 65/46 | 312/319.1 |
| 8,182,054 B2 * | 5/2012 | Liang | A47B 88/467 | 312/319.1 |
| 8,240,787 B2 * | 8/2012 | Chen | A47B 88/467 | 312/319.1 |
| 8,459,758 B2 * | 6/2013 | Rechberg | E05F 3/108 | 312/319.1 |
| 8,632,141 B2 * | 1/2014 | Park | A47B 88/493 | 312/331 |

(Continued)

FOREIGN PATENT DOCUMENTS

| | | | |
|---|---|---|---|
| KR | 200486921 Y1 * | 7/2018 | A47B 88/467 |
| WO | WO-2010043334 A1 * | 4/2010 | A47B 88/467 |
| WO | WO-2010143352 A1 * | 12/2010 | A47B 88/467 |

*Primary Examiner* — Andrew M Roersma

(57) ABSTRACT

A external mounted slow-return slide rail assembly includes a slide rail assembly including an outer slide rail affixed to an inner wall of a cabinet of a drawer set, an inner slide rail affixed to an outer wall of a sliding box of said drawer set and a bracket fastened to the outer slide rail, a cushioning device mounted on the bracket, and a transmission member mounted on one lateral surface of the sliding box. By means of mounting the cushioning device on the bracket, the cushioning device can be easily repaired, and the inventory and production costs can be greatly reduced.

5 Claims, 9 Drawing Sheets

(56) References Cited

U.S. PATENT DOCUMENTS

| | | | | |
|---|---|---|---|---|
| 8,678,528 | B2 * | 3/2014 | Domenig | A47B 88/463<br>312/334.44 |
| 8,894,164 | B2 * | 11/2014 | Zimmer | E05F 1/16<br>312/333 |
| 2007/0046159 | A1 * | 3/2007 | Hoffman | A47B 88/427<br>312/333 |
| 2013/0147335 | A1 * | 6/2013 | Chung | F25D 25/024<br>312/334.47 |
| 2014/0294328 | A1 * | 10/2014 | Pecar | A47B 88/40<br>384/20 |

* cited by examiner

EXTERNAL MOUNTED SLOW-RETURN SLIDE RAIL ASSEMBLY

BACKGROUND OF THE INVENTION

1. Field of the Invention

The present invention relates to slide rail technology and more particularly to an external mounted slow-return slide rail assembly, which has the cushioning device mounted to the outside of the slide rail assembly so that when moving the sliding box out of or into the cabinet, the transmission member at the sliding box will drive the cushioning device to move the sliding box smoothly relative to the cabinet.

2. Description of the Related Art

The slide rail cushioning device is used to buffer the movement of the inner slide rail toward the outer slide rail when the inner slide rail is received in the outer slide rail. According to conventional techniques, the cushioning device is mounted at the outer end of the outer slide rail so that the cushioning device can be activated when the inner slide rail is received in the outer slide rail. However, this cushioning device mounting arrangement relatively increases the overall length of the slide rail assembly and relatively shortens the sliding stroke. Either the cushioning device is an air cylinder, a hydraulic cylinder or an elastic member, it will wear after a long use. When the cushioning device starts to wear, a repair work or replacement will be necessary. However, it is difficult to dismount the cushioning device for repair or replacement. Furthermore, the slide rail assemblies that do not use any cushioning device are different from the slide rail assemblies that use a cushioning device, and the producer must prepare a number of different molds for production, resulting in a significant increase in inventory costs.

SUMMARY OF THE INVENTION

The present invention has been accomplished under the circumstances in view. It is therefore the main object of the present invention to provide an external mounted slow-return slide rail assembly, which facilitates repair of the cushioning device and greatly reduces the inventory and production costs.

To achieve these and other objects of the present invention, an external mounted slow-return slide rail assembly, comprises a slide rail assembly, a cushioning device, and a transmission member. The slide rail assembly comprises an outer slide rail, an inner slide rail and a bracket. The outer slide rail is affixed to an inner wall of a cabinet of a drawer set. The inner slide rail is affixed to an outer wall of a sliding box of the drawer set and slidably mounted in the outer rail and movable in and out of the outer rail when the sliding box is moved out of or into the cabinet. The outer slide rail comprises a bottom plate, and a plurality of lugs extended from one lateral side of the bottom plate. The bracket comprises a substrate, and a plurality of mounting plates extended from one lateral side of the substrate and respectively fastened to the lugs to keep the outer slide rail and the bracket in parallel. The cushioning device comprises a base frame, and a cushioning member, an elastic member and an actuating member mounted to the base frame. The actuating member is connected to the cushioning member and the elastic member and movable back and forth relative to the cushioning member and the elastic member. The base frame is connected to the bracket of the slide rail assembly. The transmission member is mounted on one lateral surface of the sliding box of the drawer set. When the sliding box is pulled out of the cabinet, the transmission member drives the actuating member to move away from the cushioning member, causing the elastic member to deform and to produce elastic restoring energy. When sliding box is pushed back into the cabinet, the actuating member is forced by the elastic restoring energy of the elastic member to move the transmission member toward the cushioning member, smoothening the movement of the sliding box toward the inside of the cabinet.

DETAILED DESCRIPTION OF THE PREFERRED EMBODIMENT

Figure 1:
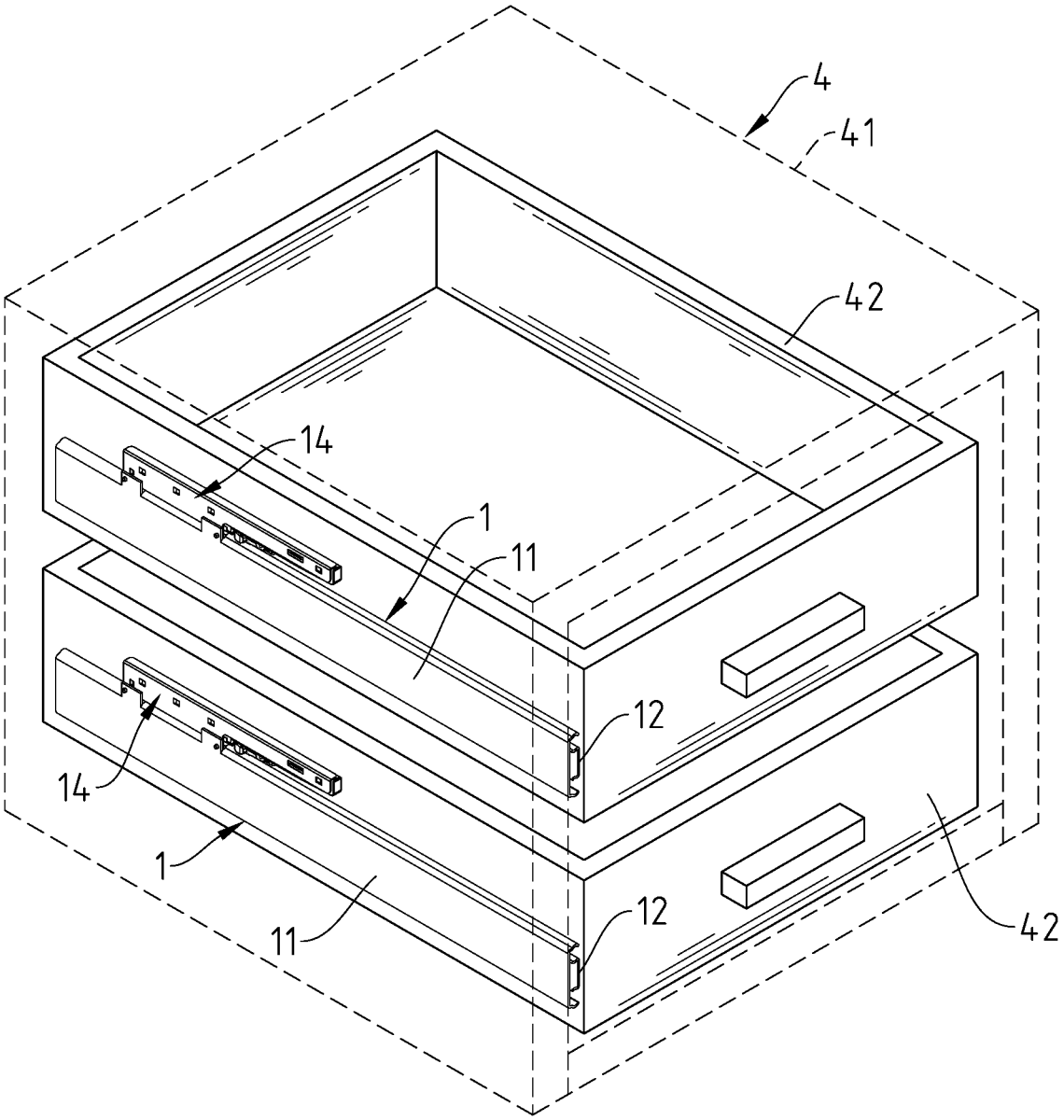
FIG. 1 is an oblique top elevational view of an external mounted slow-return slide rail assembly in accordance with the present invention.
Figure 2:
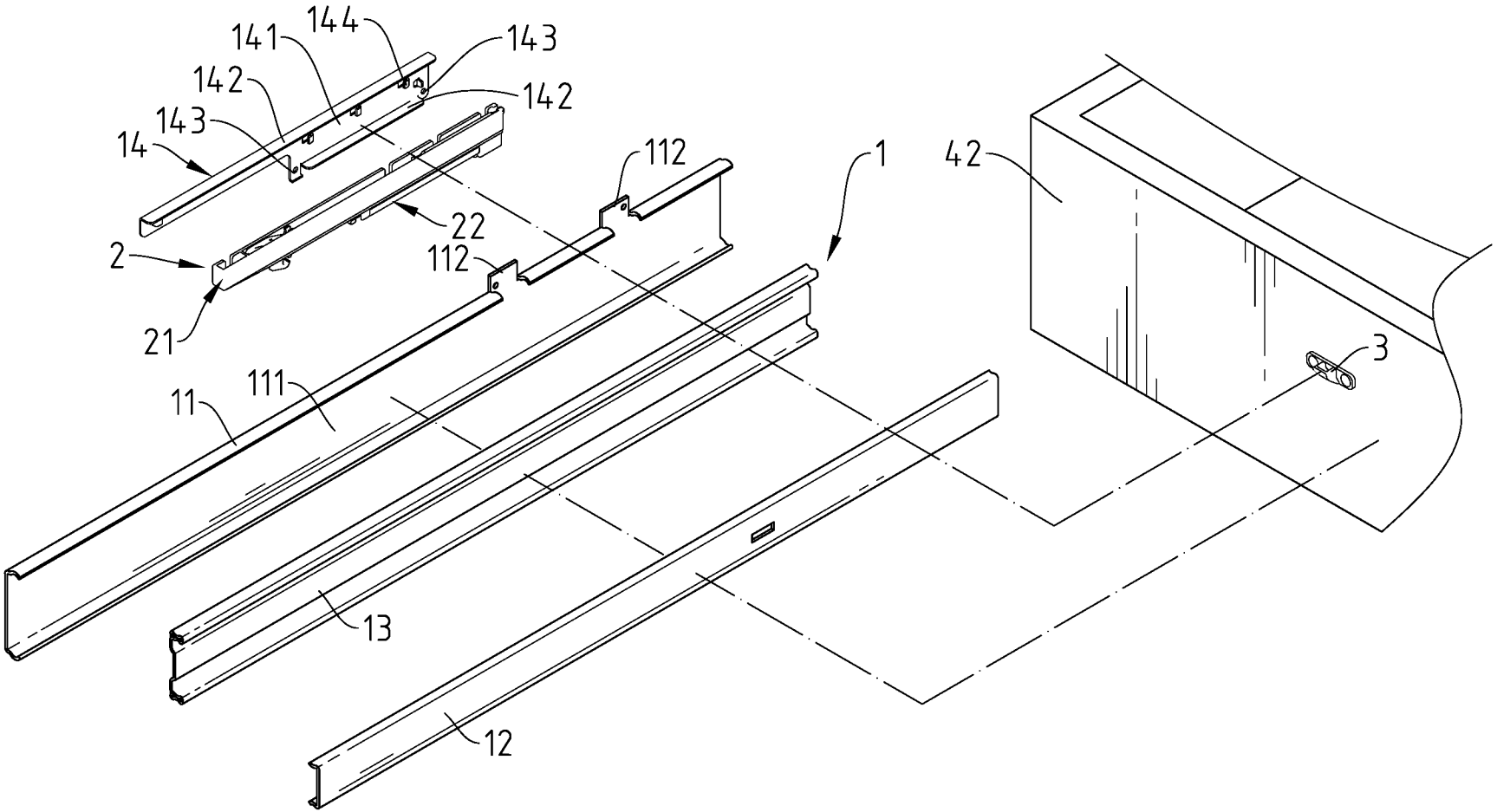
FIG. 2 is an exploded view of the external mounted slow-return slide rail assembly in accordance with the present invention.
Figure 3:
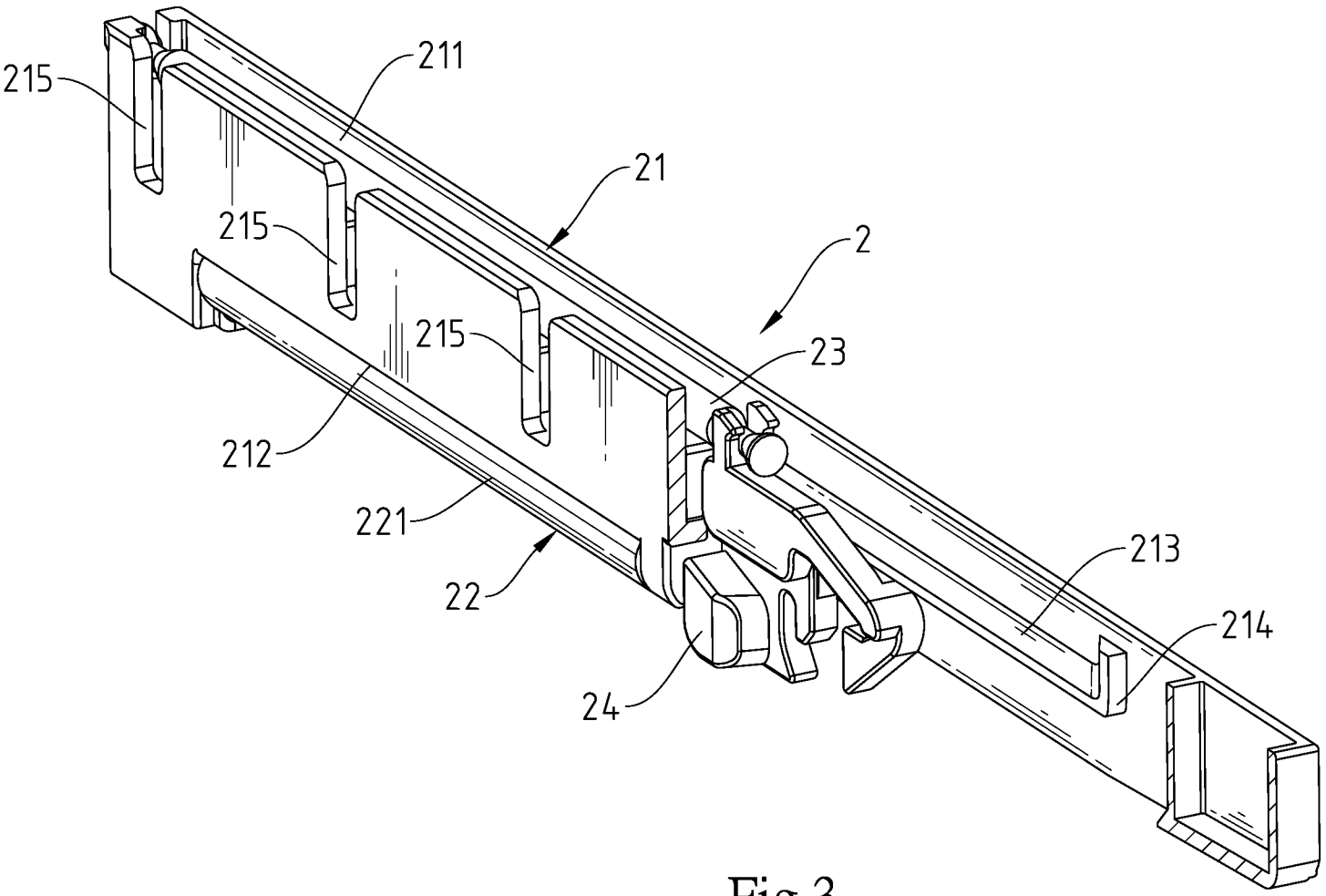
FIG. 3 is a sectional elevation of a part of the present invention, illustrating the actuating member of the cushioning device moved toward the cushioning member.
Figure 4:
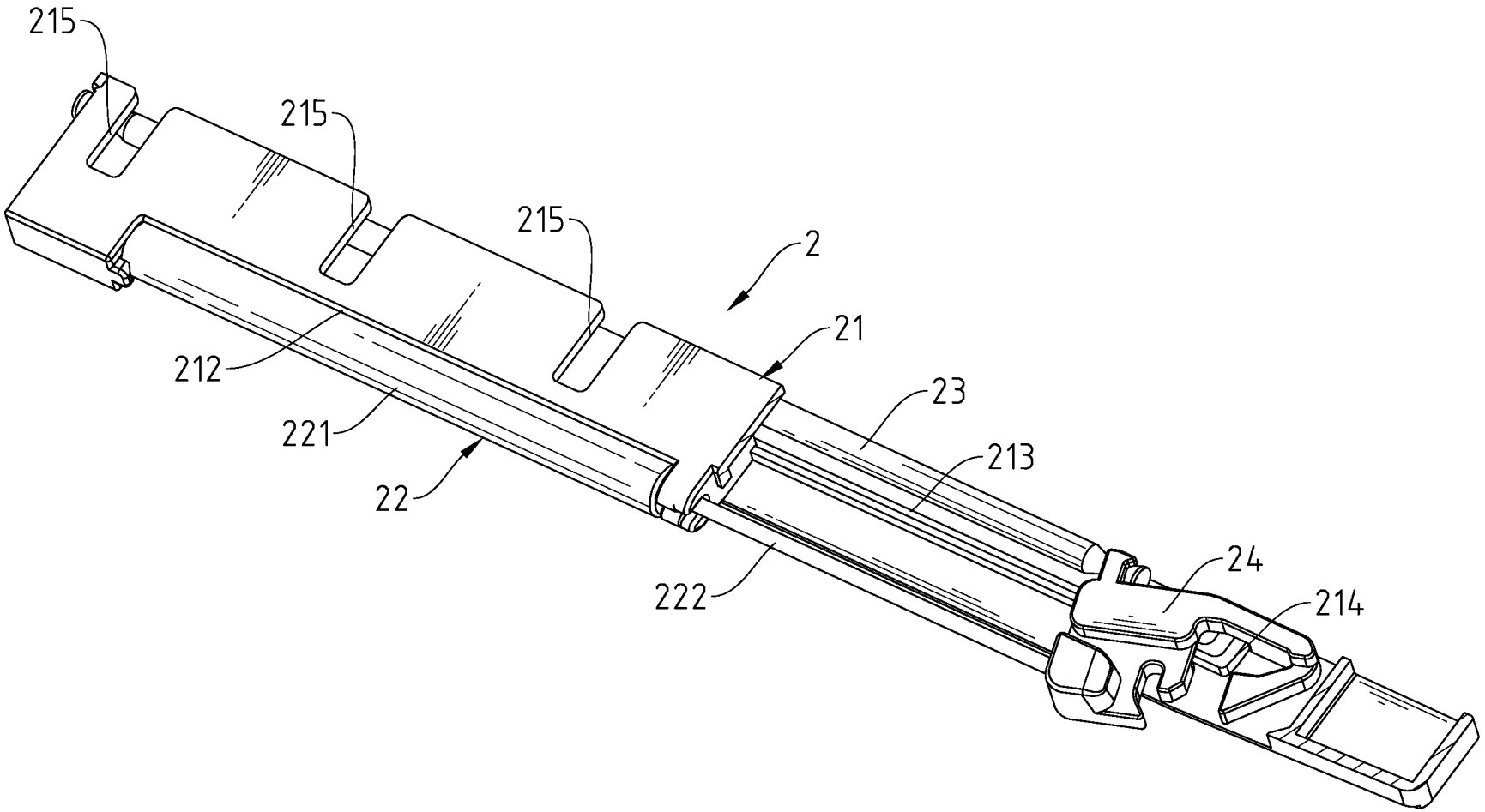
FIG. 4 is a sectional elevation of a part of the present invention, illustrating the actuating member of the cushioning device moved away from the cushioning member.
Figure 5:
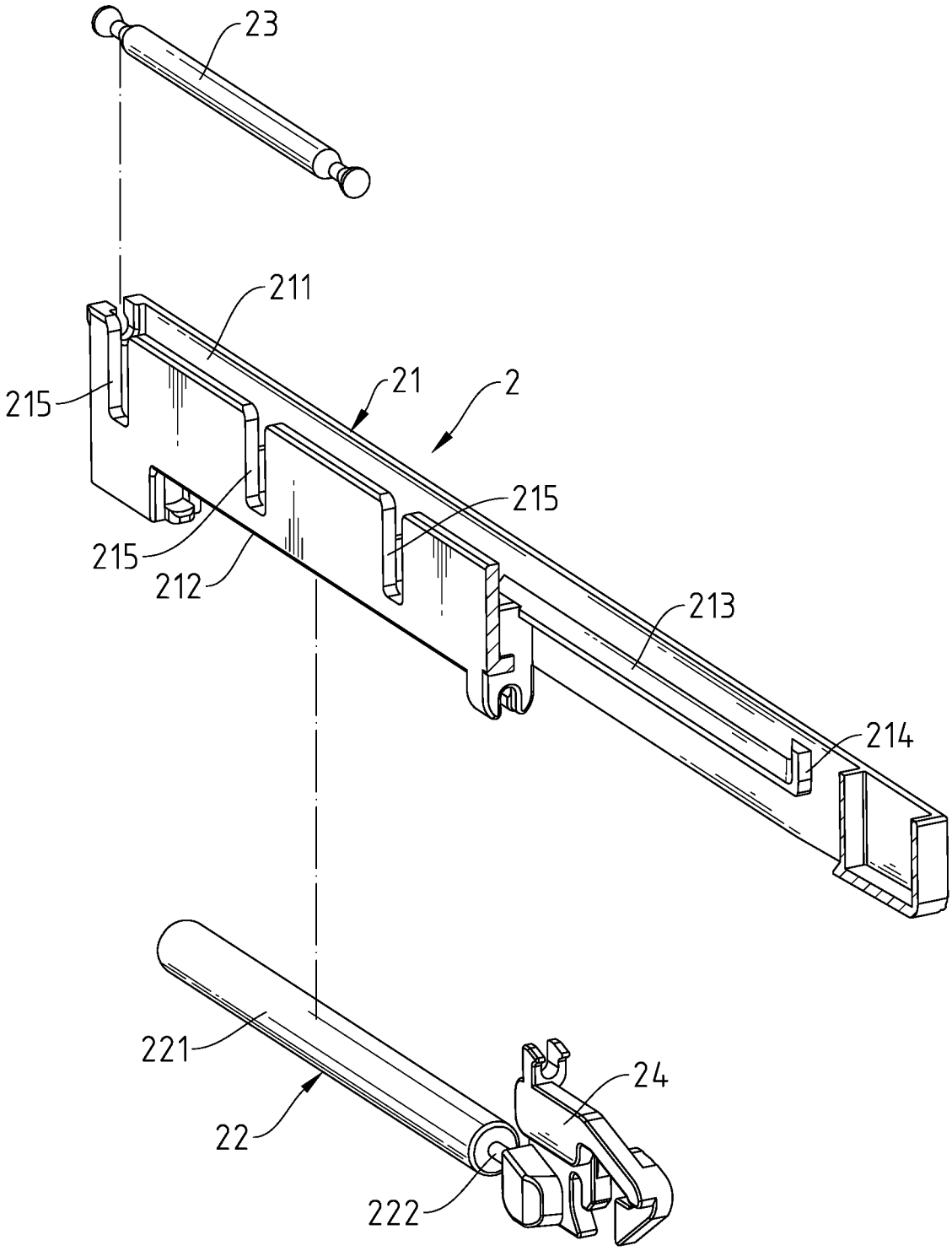
FIG. 5 is an exploded view of the cushioning device.

Referring to FIGS. 1-5, an external mounted slow-return slide rail assembly in accordance with the present invention is shown. The external mounted slow-return slide rail assembly comprises a slide rail assembly 1, a cushioning device 2, and a transmission member 3.

The slide rail assembly 1 comprises an outer slide rail 11, an intermediate rail 13, an inner slide rail 12 and a bracket 14. The outer slide rail 11 is to be affixed to an inner wall of a cabinet 41 of a drawer set 4. The inner slide rail 12 is to be affixed to an outer wall of a sliding box 42 of the drawer set 4. Further, the inner slide rail 12 is slidably mounted in the intermediate rail 13, and the intermediate rail 13 is slidably mounted in the outer slide rail 11. The outer slide rail 11 comprises a bottom plate 111, and a plurality of lugs 112 protruded from one lateral side of the bottom plate 111. The bracket 14 comprises a substrate 141, two opposite side flanges 142 respectively and perpendicularly extended from two opposite lateral sides of the substrate 141, a plurality of mounting plates 143 extended from one lateral side of the substrate 141 and respectively fastened to the lugs 112 of the outer slide rail 11 using fastening members or by welding to keep the outer slide rail 11 and the bracket 14 in parallel, and a plurality of hooks 144 protruded from an inner wall of the substrate 141.

The cushioning device 2 comprises a base frame 21, and a cushioning member 22, an elastic member 23 and an actuating member 24 disposed on the base frame 21. The actuating member 24 is connected to the cushioning member 22 and the elastic member 23. The base frame 21 comprises a plurality of hook holes 215 located on a bottom wall thereof, an accommodation slot 211 and a positioning slot 212 respectively defined in two opposite sides thereof, a track 213 disposed at a rear side relative to the accommodation slot 211 and the positioning slot 212, and a notch 214 located on a distal end of the track 213 and disposed in communication with the accommodation slot 211 and the positioning slot 212. The cushioning member 22 comprises a buffer 221, and an actuating rod 222 connected to the buffer 221. The buffer 221 is positioned in the positioning slot 212. The elastic member 23 is positioned in the accommodation slot 211. The actuating member 24 is abutted to the track 213 and connected to the actuating rod 222 and the elastic member 23. Further, the hook holes 215 of the base frame 21 are respectively fastened to the hooks 144 of the bracket 14 so that the side flanges 142 of the bracket 14 respectively cover the accommodation slot 211 and the positioning slot 212.

The transmission member 3 is mounted on one lateral surface of the sliding box 42 of the drawer set 4.

Figure 6:
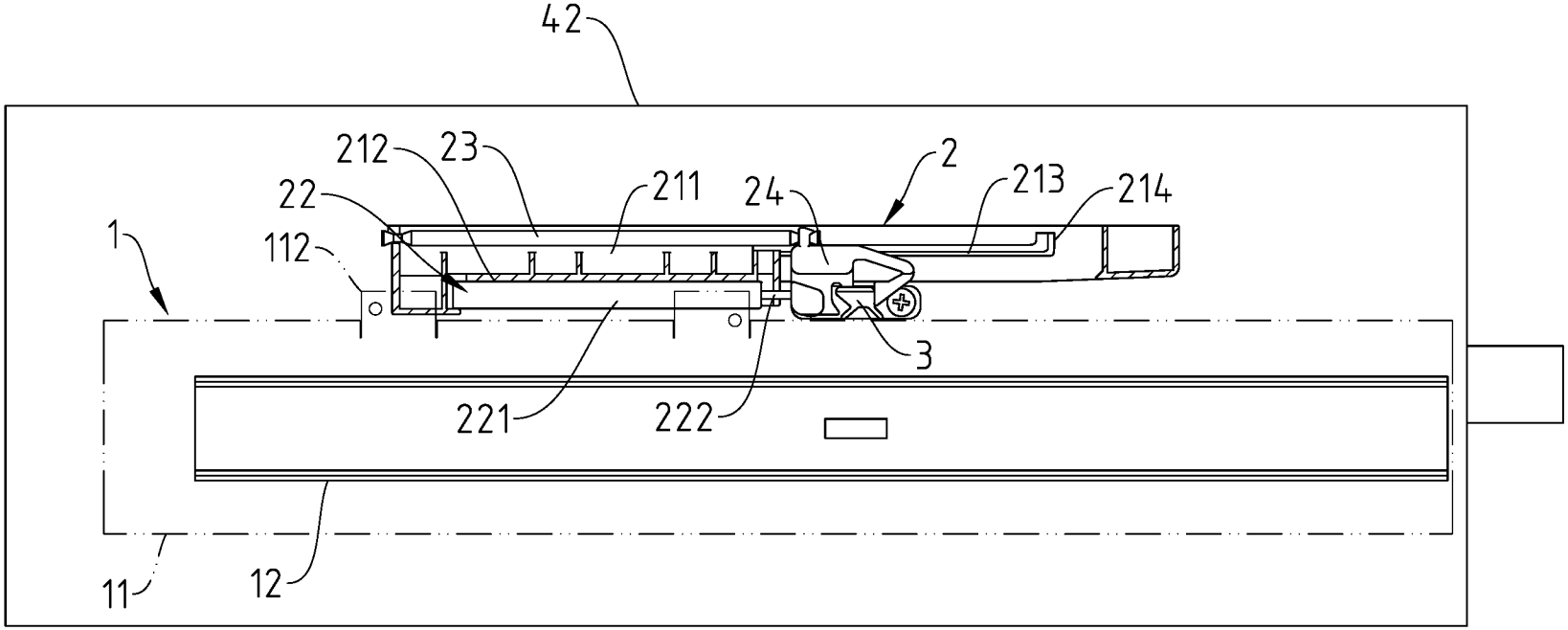
FIG. 6 is a schematic drawing of the present invention, showing the sliding box received in the cabinet.
Figure 7:
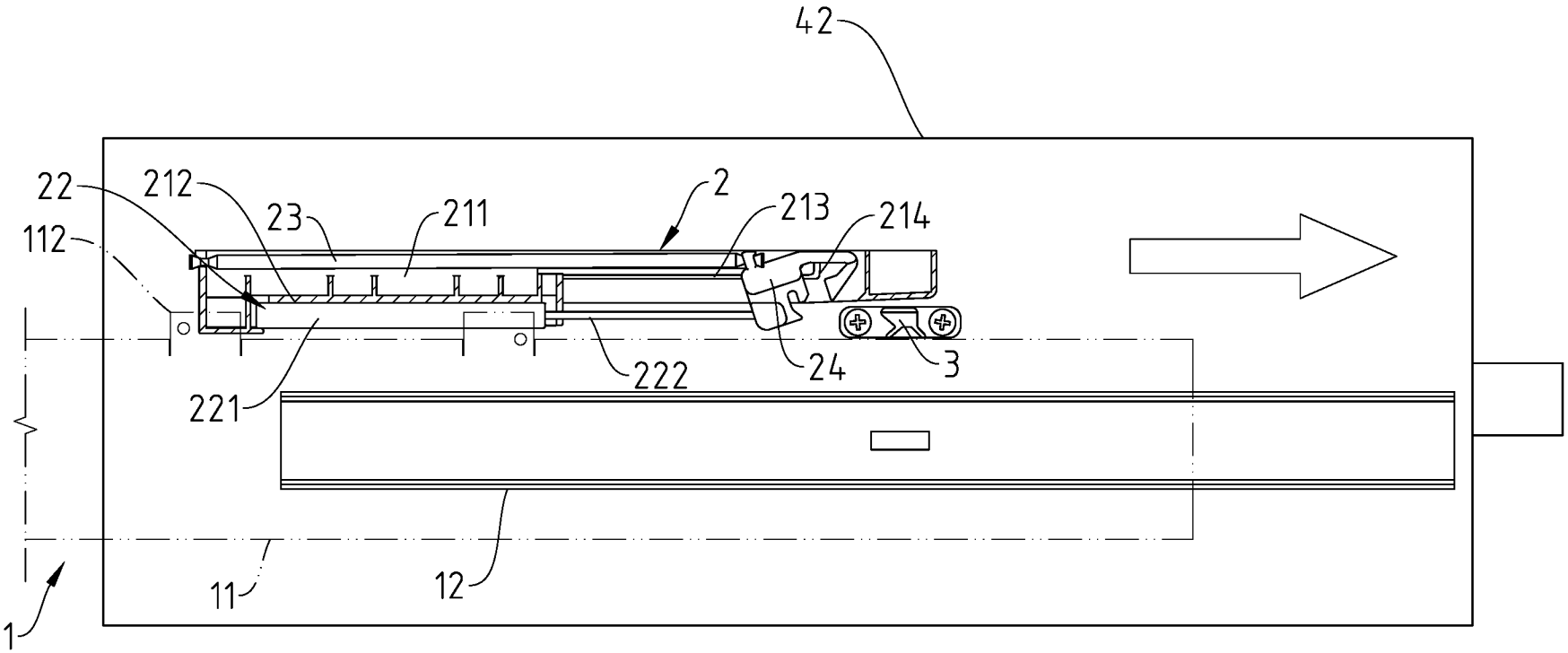
FIG. 7 is a schematic drawing of the present invention, showing the sliding box extended out of the cabinet.
Figure 8:
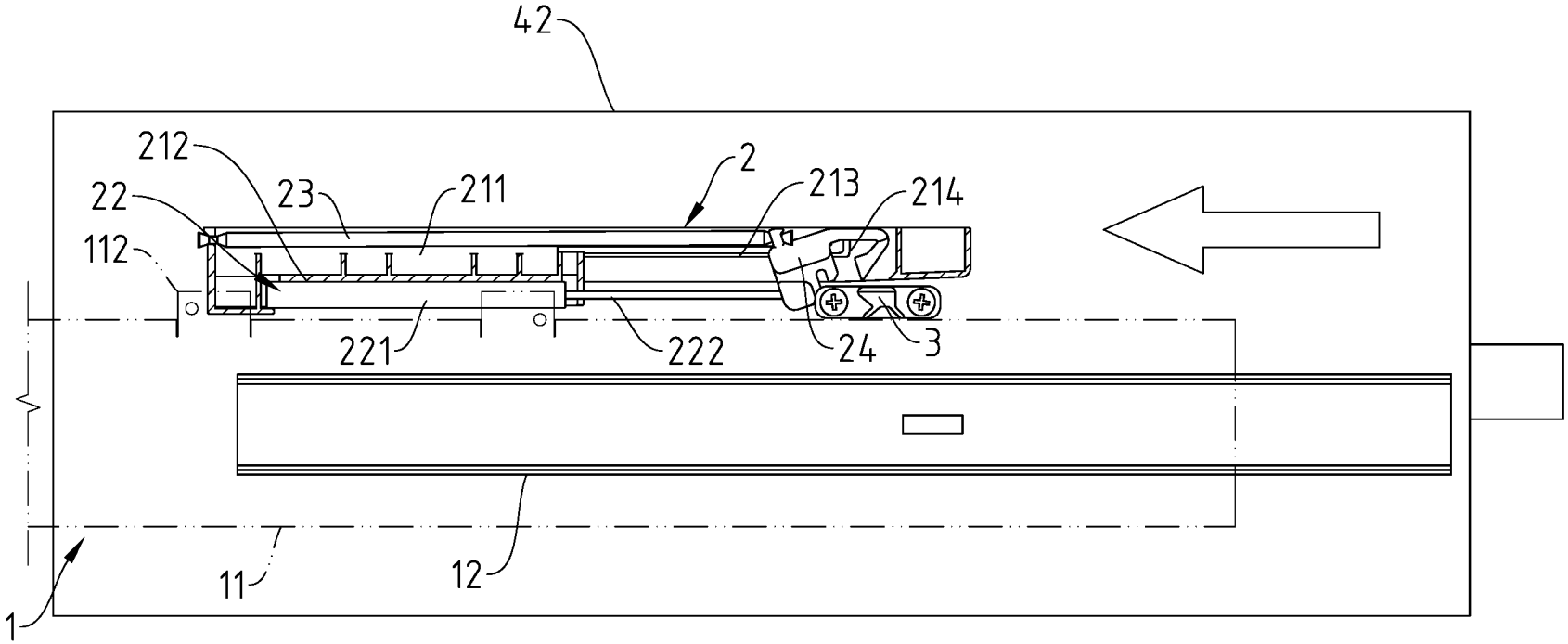
FIG. 8 is a schematic drawing of the present invention, showing the sliding box moved toward the inside of the cabinet.
Figure 9:
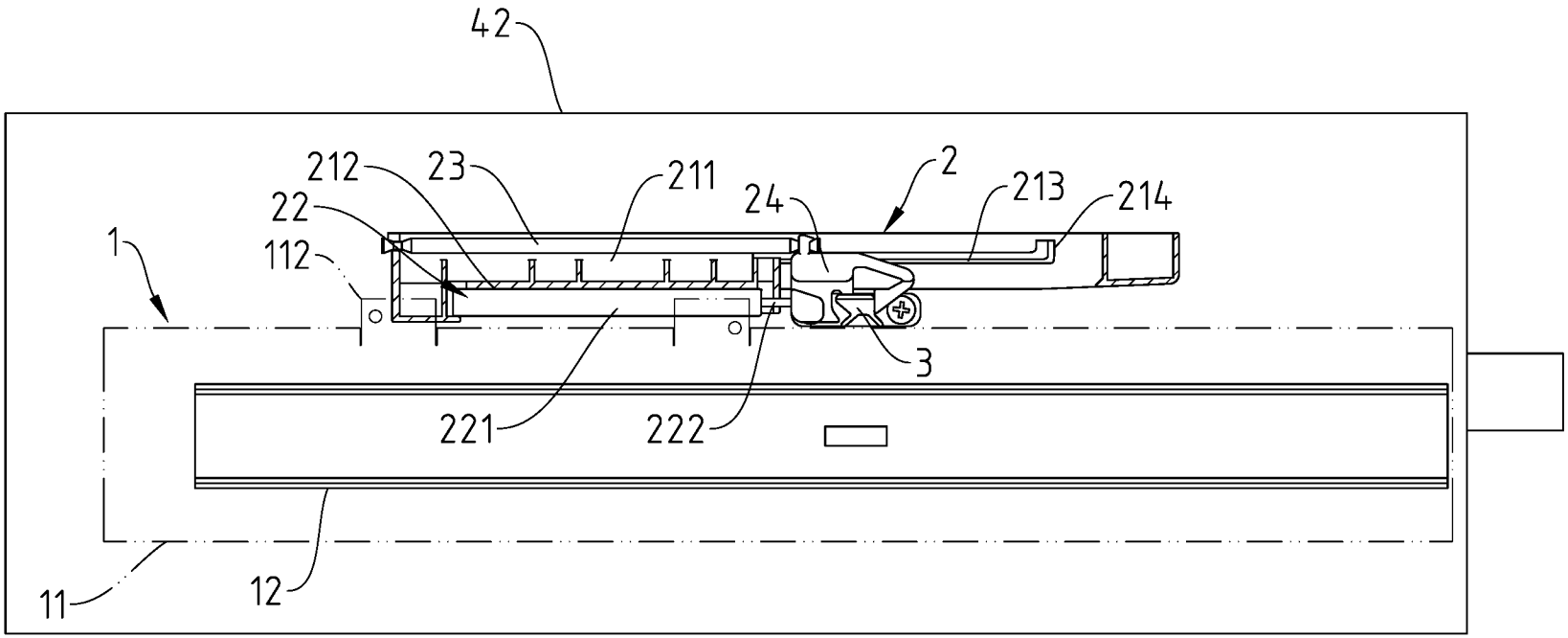
FIG. 9 is a schematic drawing of the present invention, showing the sliding box completely received in the cabinet.

Referring to FIGS. 6-9 and FIG. 1 again, it can be seen from FIGS. 6 and 7 that when pulling the sliding box 42 out of the cabinet 41, the transmission member 3 will drive the actuating member 24 to move away from the cushioning member 22, causing the elastic member 23 to deform and to produce elastic restoring energy, and the transmission member 3 will be engaged in the notch 214, allowing the sliding box 42 to be completely pulled out of the cabinet 41. As illustrated in FIGS. 8 and 9, when pushing the sliding box 42 back into the cabinet 41, the actuating member 24 will push the transmission member 3 away from the notch 214, allowing the actuating member 24 to be forced by the elastic restoring energy of the elastic member 23 to carry the transmission member 3 toward the cushioning member 22. Subject to the effect of the cushioning member 22, the sliding box 42 is smoothly received in the cabinet 41.

What is claimed is:

1. An external mounted slow-return slide rail assembly, comprising:

a slide rail assembly comprising an outer slide rail, an inner slide rail, and a bracket, said outer slide rail being affixed to an inner wall of a cabinet of a drawer set, said inner slide rail being affixed to an outer wall of a sliding box of said drawer set and slidably mounted in said outer rail and movable in and out of said outer rail when said sliding box is moved out of or into said cabinet, said outer slide rail comprising a bottom plate and a plurality of lugs extending from one side of said bottom plate, said bracket comprising a substrate and a plurality of mounting plates extending from one side of said substrate and respectively fastened to said lugs to keep said outer slide rail and said bracket parallel;

a cushioning device comprising a base frame, a cushioning member, an elastic member, and an actuating member mounted to said base frame, said base frame comprising an accommodation slot and a positioning slot respectively defined in two opposite sides thereof, said elastic member and said cushioning member respectively positioned in said accommodation slot and said positioning slot, said substrate of said bracket of said slide rail assembly comprising two opposite side flanges respectively covering said accommodation slot and said positioning slot, said actuating member being connected to said cushioning member and said elastic member and movable back and forth relative to said cushioning member and said elastic member, said base frame being connected to said bracket of said slide rail assembly; and a transmission member mounted on one lateral surface of said sliding box of said drawer set;

wherein when said sliding box is pulled out of said cabinet, said transmission member drives said actuating member to move away from said cushioning member, causing said elastic member to deform and to produce elastic restoring energy; when said sliding box is pushed back into said cabinet, said actuating member is forced by the elastic restoring energy of said elastic member to move said transmission member toward said cushioning member.

2. The external mounted slow-return slide rail assembly as claimed in claim 1, wherein said base frame of said cushioning device comprises an accommodation slot and a positioning slot respectively defined in two opposite sides thereof, a track disposed at a rear side relative to said accommodation slot and said positioning slot, and a notch located on a distal end of said track and disposed in communication with said accommodation slot and said positioning slot; said cushioning member comprises a buffer positioned in said positioning slot and an actuating rod coupled to said buffer; said elastic member is positioned in said accommodation slot, said actuating member abutting said track and connected to said actuating rod and said elastic member so that when said sliding box is pulled out of said cabinet and said transmission member drives said actuating member to move away from the cushioning member, said transmission member is engaged in said notch, allowing said sliding box to be completely pulled out of said cabinet; when said sliding box is pushed back into said cabinet, said actuating member pulls said transmission member out of said notch toward said cushioning member, allowing said sliding box to be received in said cabinet.

3. The external mounted slow-return slide rail assembly as claimed in claim 1, wherein said substrate of said bracket of said slide rail assembly comprises a plurality of hooks protruding from an inner wall thereof; said base frame of said cushioning device comprises a plurality of hook holes located on a bottom wall thereof and respectively engaged with said hooks of said base frame of said cushioning device to secure said base frame to said substrate.

4. The external mounted slow-return slide rail assembly as claimed in claim 1, wherein said lugs of said outer slide rail are respective fastened to said mounting plates of said bracket with fastening members.

5. The external mounted slow-return slide rail assembly as claimed in claim 1, wherein said lugs of said outer slide rail are respective fastened to said mounting plates of said bracket by welding.

* * * * *